United States Patent [19]

Tatsumi

[11] Patent Number: 4,780,710

[45] Date of Patent: Oct. 25, 1988

[54] MULTIWINDOW DISPLAY CIRCUIT

[75] Inventor: Hidenori Tatsumi, Nara, Japan

[73] Assignee: Sharp Kabushiki Kaisha, Osaka, Japan

[21] Appl. No.: 626,995

[22] Filed: Jul. 2, 1984

[30] Foreign Application Priority Data

Jul. 8, 1983 [JP] Japan ..... 58-125094
Jul. 8, 1983 [JP] Japan ..... 58-125095

[51] Int. Cl.[4] ..... G09G 1/16

[52] U.S. Cl. ..... 340/721; 340/723; 340/724; 340/747

[58] Field of Search ..... 340/721, 723, 724, 750, 340/747, 709

[56] References Cited

U.S. PATENT DOCUMENTS

| | | | |
|---|---|---|---|
| 4,197,590 | 4/1980 | Sukonick et al. | 340/721 X |
| 4,201,983 | 5/1980 | Magerl et al. | 340/724 X |
| 4,246,578 | 1/1981 | Kawasaki et al. | 340/724 X |
| 4,309,700 | 1/1982 | Kraemer | 340/723 X |
| 4,342,990 | 8/1982 | Traster | 340/724 |
| 4,360,831 | 11/1982 | Kellor | 340/721 X |
| 4,437,093 | 3/1984 | Bradley | 340/747 X |
| 4,439,760 | 3/1984 | Fleming | 340/747 X |
| 4,491,834 | 1/1985 | Oguchi | 340/723 X |
| 4,509,043 | 4/1985 | Mossaides | 340/721 |
| 4,533,910 | 8/1985 | Sukonick et al. | 340/798 X |
| 4,545,070 | 10/1985 | Miyagawa et al. | 340/723 X |
| 4,550,315 | 10/1985 | Bass et al. | 340/723 |
| 4,618,858 | 10/1986 | Bulch | 340/723 |

FOREIGN PATENT DOCUMENTS 2078411 1/1982 United Kingdom .

*Primary Examiner*—Gerald L. Brigance
*Attorney, Agent, or Firm*—Birch, Stewart, Kolasch & Birch

[57] ABSTRACT

A multiwindow display circuit comprises a horizontal boundary memory for storing horizontal boundary data of display windows, a vertical boundary memory for storing vertical boundary data of the display windows, a display address memory for storing an address of each of the display windows, a picture information memory for storing picture information related to the address stored within the display address memory, a bias value memory for storing bias values for the display windows, an address converter for adding a selected one of the bias values to the address of the display address memory to convert the display address, and a display responsive to the converted address for displaying any portion of the picture information memory at any area of display.

5 Claims, 7 Drawing Sheets

MULTIWINDOW DISPLAY CIRCUIT

BACKGROUND OF THE INVENTION

The present invention relates to a display circuit and, more particularly, to a multiwindow display circuit in which a plurality of displays are windowed in a single frame.

A multiwindow display, for example, in a computer is a division of the display screen into a plurality of sections or windows in which the respective pictures are displayed.

FIG. 1(B) is a schematic drawing of a conventional multiwindow picture, in which a single picture frame is divided into "n" windows. FIG. 1(A) is a memory format for windowing the displays of FIG. 1(B). Conventionally, the memory must store a plurality of items of picture information identically and respectively corresponding to the windowed pictures. Therefore, to shift the position or change the size of at least one of the windowed displays, the memory contents must be changed so as to identically and respectively correspond to the windows. This is disadvantageous to circuit design.

SUMMARY OF THE INVENTION

Accordingly, it is an object of the present invention to provide an improved multiwindow display circuit for easy and speedy shifting of the positions of windowed pictures and changing the sizes and the contents of the windowed pictures.

It is another object of the present invention to provide an improved bias register for a multiwindow display circuit for easy and speedy shifting of the positions of windowed pictures and changing the sizes and the contents of the windowed pictures.

It is a further object of the present invention to provide an improved priority register for a multiwindow display circuit for selecting window priority data, so that divided pictures are windowed with priority and overlapped.

Other objects and further scope of applicability of the present invention will become apparent from the detailed description given hereinafter. It should be understood, however, that the detailed description of and specific examples, while indicating preferred embodiments of the invention, are given by way of illustration only, since various changes and modifications within the spirit and scope of the invention will become apparent to those skilled in the art from this detailed description.

To provide the above objects, according to a preferred embodiment of the present invention, a multiwindow display circuit comprises horizontal frame memory means for storing horizontal boundary data of display windows, vertical frame memory means for storing vertical boundary data of the display window, display address means for storing an address of each of the display windows, picture information memory means for storing picture information related to the address stored in the display address means, bias value memory means for storing each bias value for the display windows, address converter means for adding a selected one of the bias values to the address of the display address means to convert the display address, and display means responsive to the converted address for displaying any portion of the picture information at any area of the display means. Priority means may be provided for selecting priroity overlapping of the display windows.

BRIEF DESCRIPTION OF THE DRAWINGS

The present invention will be better understood from the detailed description given hereinbelow and the accompanying drawings which are given by way of illustration only, and thus are not limitative of the present invention and wherein.

DETAILED DESCRIPTION OF THE INVENTION

Figure 2A:
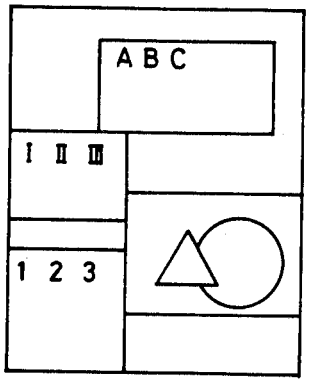
FIGS. 2(A) and 2(B) are schematic drawings of memory contents and a multiwindowed picture, according to a first preferred embodiment of the present invention, respectively.
Figure 2B:
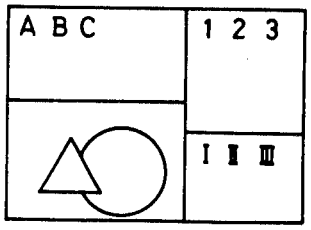

FIGS. 2(A) and 2(B) show a format of a memory and a multiwindow picture according to a first preferred embodiment of the present invention, respectively. A plurality of items of picture information for a multiwindow are stored, randomly, within a plurality of memory portions, as shown in FIG. 2(A), so that the multiwindow picture of FIG. 2(B) can be enabled. The divided pictures can be moved and shifted, with changing of sizes, and the picture contents of the respective windows can be changed, according to the present invention.

Figure 3:
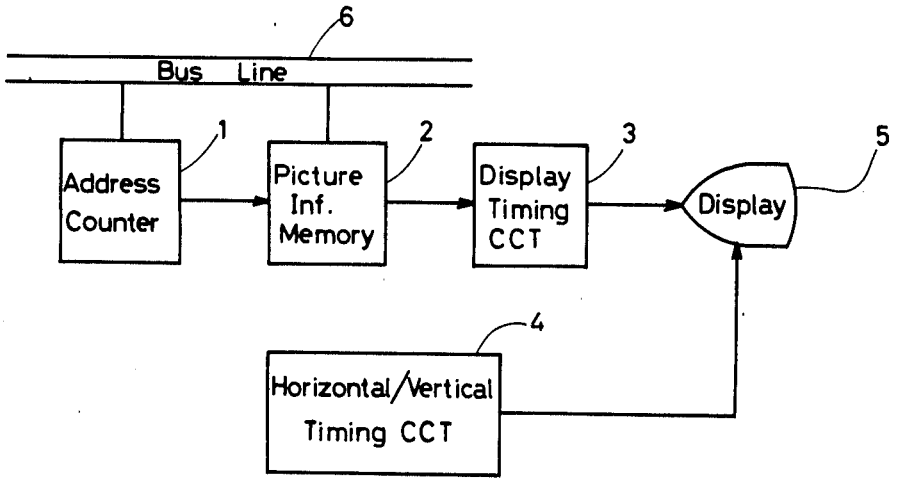
FIG.3 (PRIOR ART)
FIG. 3 is a block diagram of a conventional multiwindow display circuit.

FIG. 3 is a block diagram of a conventional multiwindow display circuit. The circuit comprises an address counter 1, a picture information memory 2, a display timing circuit 3, a horizontal/vertical timing circuit 4, and a display 5. A bus line 6 is provided for coupling the address counter 1 and the picture information memory 2. The address counter 1 is provided for subsequentially selecting the contents of the picture information memory 2, so that the contents are subjected to timing control by the display timing circuit 3 and horizontal/vertical timing circuit 4 to display the contents in the display 5.

Figure 1:
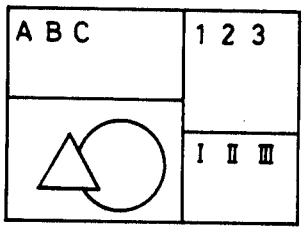
FIGS. 1(A) and 1(B) are schematic drawings of conventional memory contents and a conventional multiwindowed picture, respectively.
Figure 1:
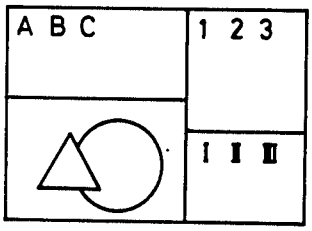
FIG.1 (B) (PRIOR ART)

Since the address counter 1 merely subsequentially selects the contents of the picture information memory 2, the picture information memory 2 must store identically and respectively corresponding information as shown in FIG. 1(A) to display the multiwindow of FIG. 1(B).

According to the present invention it is unnecessary for the picture information memory 2 to store picture information identically and respectively corresponding to the display contents. It is possible for desired parts of the picture information to be mixed to display the multiwindow.

Figure 4:
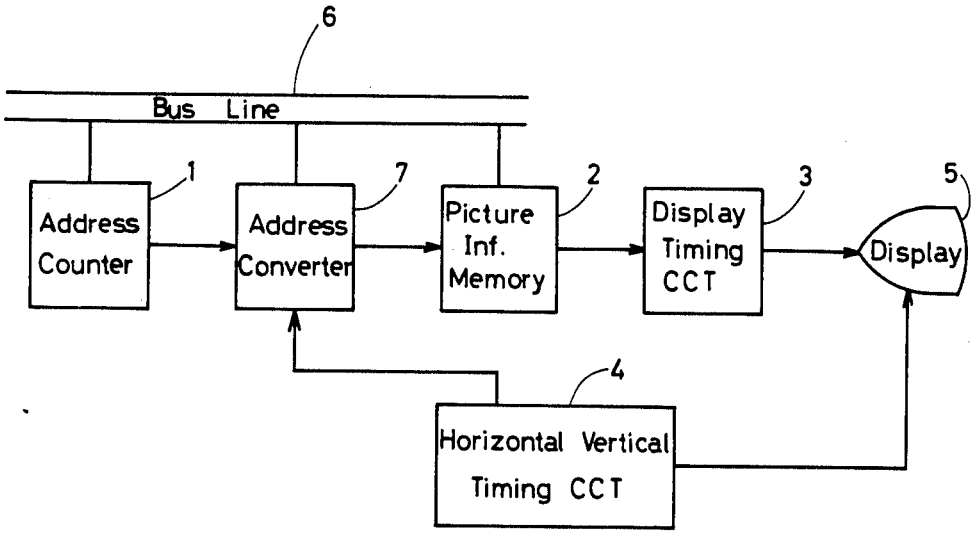
FIG. 4 is a block diagram of a multiwindow display circuit according to the first preferred embodiment of the present invention.

FIG. 4 is a block diagram of a multiwindow display circuit according to the first preferred embodiment of the present invention. Like elements corresponding to those of FIG. 3 are indicated by like numerals.

According to the present invention, an address converter 7 is interposed bewteen the address counter 1 and the picture information memory 2. Rather than sequentially selecting the picture information in order, the address converter 7 can freely change the addresses for directing each of the items of the picture information, so that any desired address of the picture information can be selected and displayed.

Figure 5:
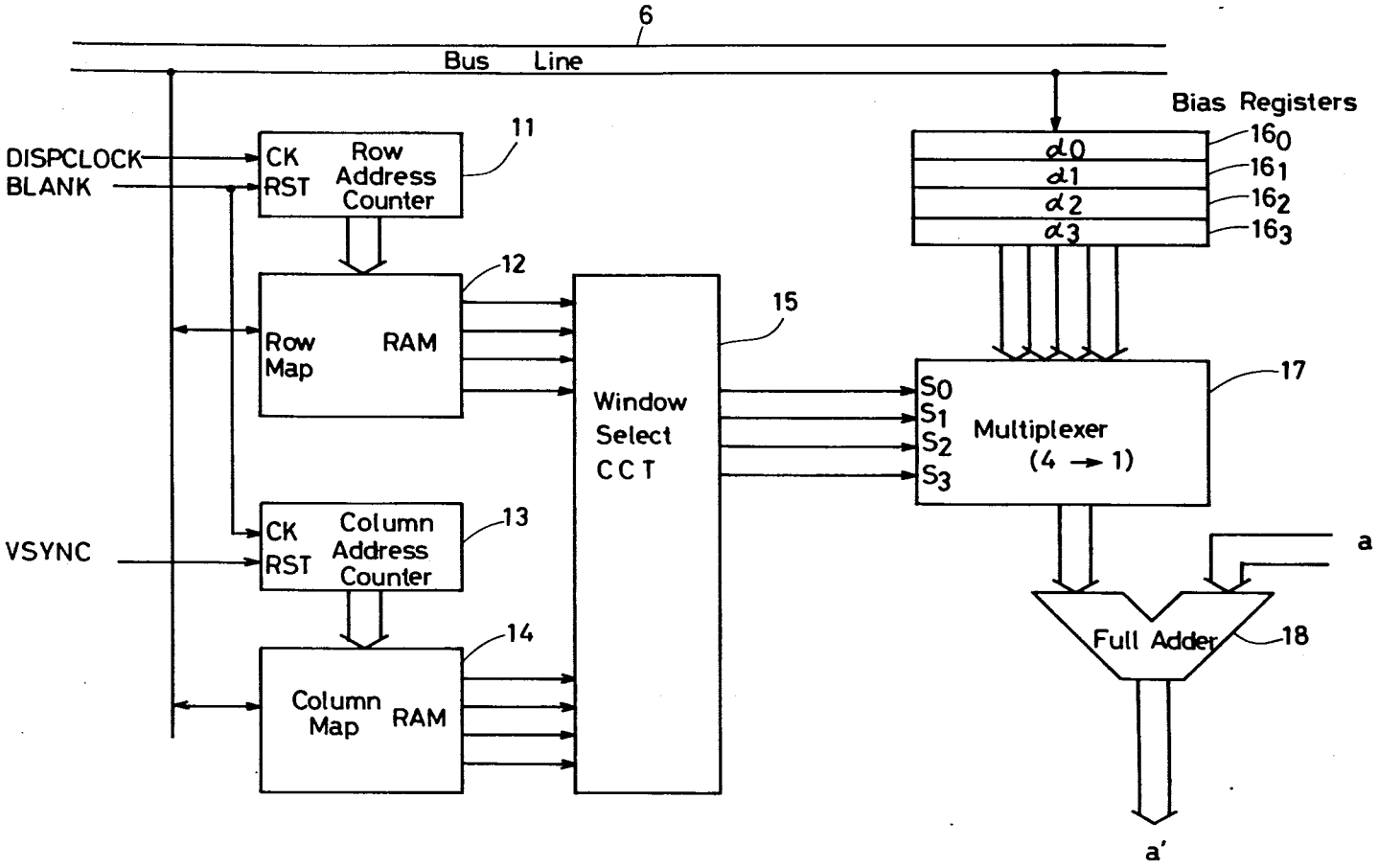
FIG. 5 is a block diagram of an address converter according to the first preferred embodiment of the present invention.
Figure 6A:
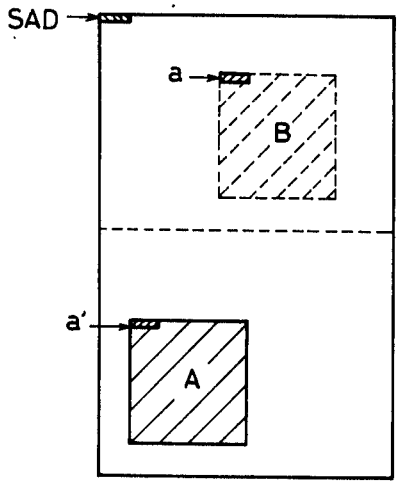
FIGS. 6(A) and 6(B) are schematic drawings of memory contents and the multiwindowed picture according to the first preferred embodiment of the present invention.
Figure 6B:
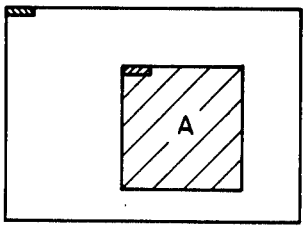

FIG. 5 is a block diagram of the address converter 7 of FIG. 4. FIGS. 6(A) and 6(B) are a schematic format of the picture information memory 2 and a multiwindow display, respectively, by converting the address with the address converter 7.

Conventionally, a display start address "SAD" and its following addresses which are all positioned above the dotted line of FIG. 6(A) relate to picture information to be displayed in the display 5. To display the display of FIG. 6(B) in which the memory area "A" is displayed at the window display, the memory area "A" is shifted to the memory area "B". For this purpose, the address for directing the memory area "B" is changed to be directing the memory area "A". The leading address of the memory area "B" is assumed to be a while the leading address of the memory are "A" is assumed to be a'. It is assumed that $a'-a=\text{alpha}$.

When the address counter becomes "alpha", starting with the display start address SAD, the bias value "alpha" is added as follows:

$$a+\text{alpha}=a'$$

This means that the memory contents of the memory area "A" is displayed at the previous display area for the memory area "B", so that the display of FIG. 6(B) can be enabled.

However, such information is not sufficient because of the absence of information for indicating the limits of the memory area "A". This area limitation is referred to as a "window". The display 5 does nothing but display the picture information corresponding to the memory area "A" and its surrounding area to display a single picture frame.

Figure 7:
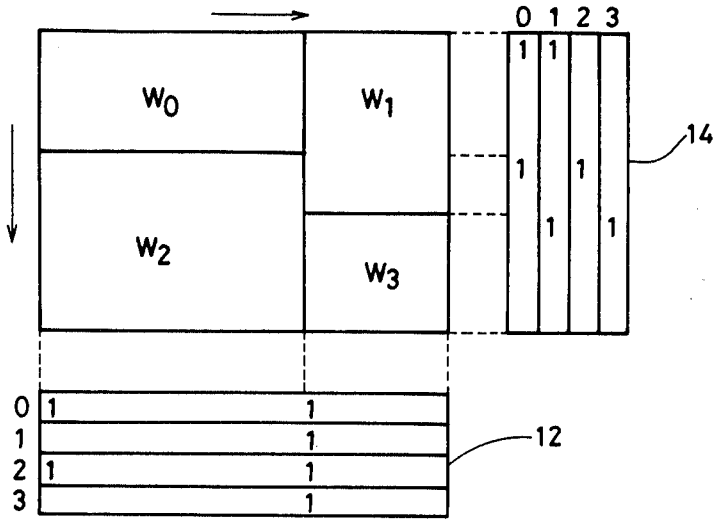
FIG. 7 is an explanary drawing of a row map RAM and a column map RAM connected in the circuit of FIG. 5.

Referring now to FIG. 5, to decide the "window" area, a row address counter 11, a row map random access memory (RAM) 12, a column address counter 13, a column map RAM 14, and a window select circuit 15 are provided. The row address counter 11 is responsive to display clocks "DISP CLOCK" as counter clock signals, and horizontal and vertical blanking signals "BLANK" as reset signal for horizontally counting the display screen. The column address counter 13 is responsive to the horizontal and vertical blanking signals "BLANK" as clock signals and vertical snychronizing signals "VSYNC" as reset signals for vertically counting the display screen. As shown in FIG. 7, the row map RAM 12 is a first display boundary memory for horizontally storing corner points of divided windows W0–W3 and the column map RAM 14 is a second display boundary memory for vertically storing corner points of the divided windows W0–W3. To define a single divided window, each of the display boundary memories is provided for storing points representative of its four corners. A plurality of bias registers $\mathbf{16}_0$–$\mathbf{16}_3$ are provided for storing bias values for address conversion. A multiplexer 17 is responsive to the signals from the window select circuit 15 and the bias values from the bias registers 16 for selecting each of the bias values to be added to each of the addresses. A full adder 18 is provided for adding each of the bias values to each of the addresses.

Figure 8:
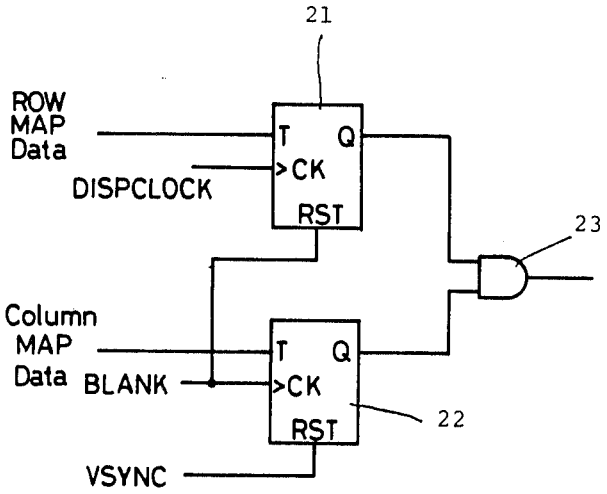
FIG. 8 is a block diagram of a window select circuit connected in the circuit of FIG. 5.

FIG. 8 is a block diagram of the window select circuit 15 of FIG. 5. The window select circuit 15 comprises two T-type flip-flops 21 and 22, and an AND gate 23. Once the row map RAM 12 outputs row map data on a high level "1" to the T-type flip-flop 21 and the column map RAM 14 outputs column map data on the high level "1" to the T-type flip-flop 22, the window select circuit 15 becomes conductive before the next data of "1" level are inputted into the T-type flip-flops 21 and 22. Unless both of the row map data and the column map data are on the "1" level, the relevant window cannot be selected. More particularly, responsive to the row map data and the column map data both of the "1" level, the T-type flip-flops 21 and 22 develop its Q output on the high level "1" before the next data of the "1" level are inputted into the T-type flip-flops 21 and 22. The AND gate 23 is responsive to the outputs of "1" of the T-type flip-flops 21 and 22 for developing its output of "1". Thus, the AND gate 23 outputs the high level output whenever the data area is included within the respective window area of FIG. 7. When four windows are used, four sets of the T-type flip-flops 21 and 22, and the AND gate 23 are needed.

Both of the row map RAM 12 and the column map RAM 14 provide the map data for defining what window is to be selected. The multiplexer 17 is responsive to a selected one of window numbers S0-S3 for causing one of the bias registers $\mathbf{16}_0$–$\mathbf{16}_3$ to develop its bias value corresponding to the selected one of the window numbers S0–S3. The full adder 18 is operated to add the bias value among "$\text{alpha}_0$–$\text{alpha}_3$" to the address a from each of the address counters 11 and 13. Thus, the address a' is obtained, accessing a location of the window picture information to be displayed.

Since the contents of all of the row map RAM 12, the column map RAM 14, and the bias registers $\mathbf{16}_0$–$\mathbf{16}_3$ can be freely renewed, any desired portions of the picture information memory can be displayed in any portion of the display screen. The multiwindow can be promptly moved and shifted, and the size of the multiwindow can be promptly changed without changing the contents of the picture information memory 2.

It may be evident that the number of the multiwindows should not be limited to four.

A second preferred embodiment of the present invention will now be described.

Figure 9:
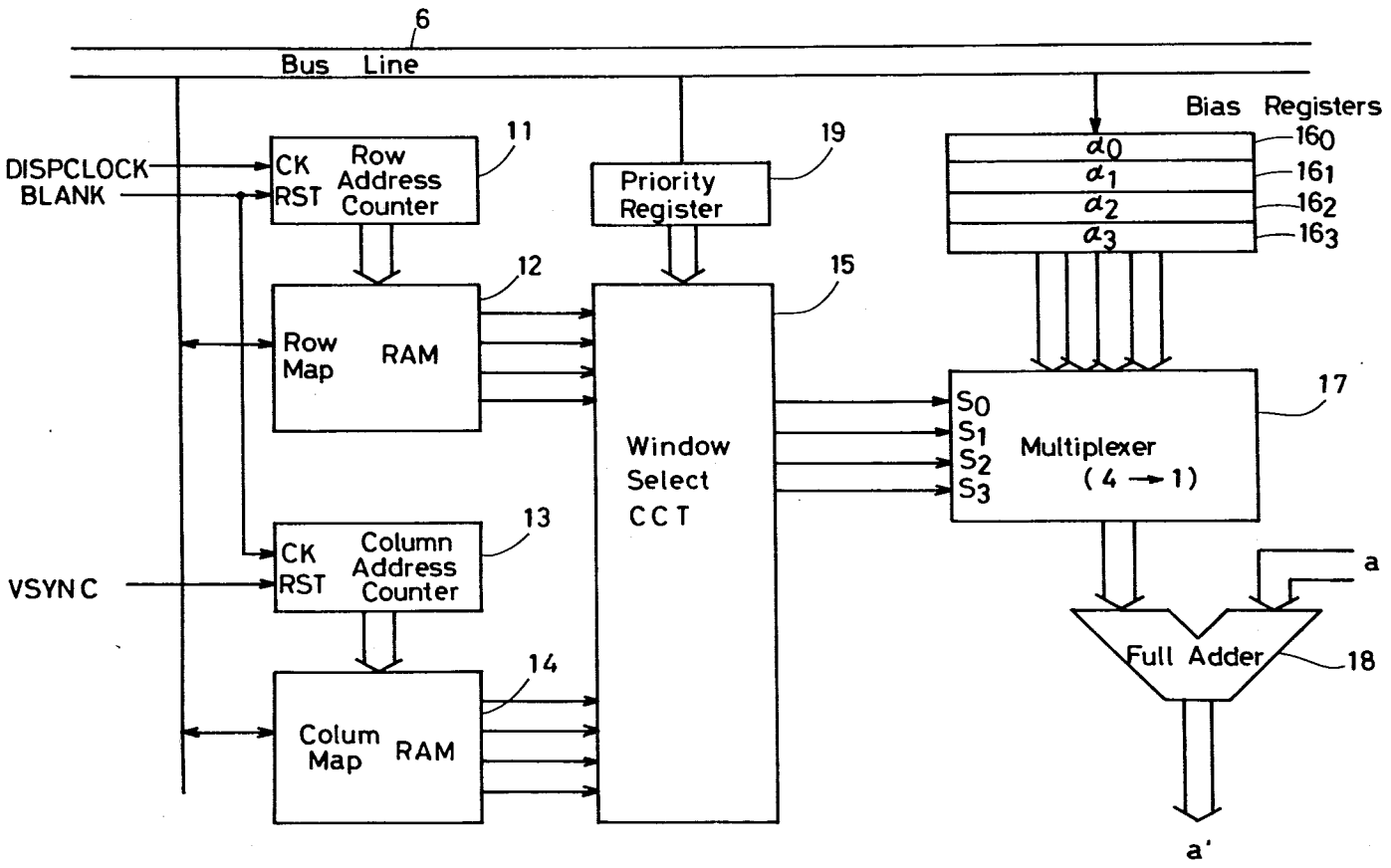
FIG. 9 is a block diagram of an address converter for a multiwindow display circuit according to a second preferred embodiment of the present invention.

FIG. 9 is a block diagram of a multiwindow circuit according to the second preferred embodiment of the present invention. Like elements corresponding to those of FIG. 5 are indicated by like numerals.

In accordance with this second preferred embodiment of the present invention, a priority register 19 is interposed between the bus line 6 and the window select circuit 15. The priority register 19 is provided for defining priority of partially overlapping a plurality of multiwindow pictures.

Figure 11:
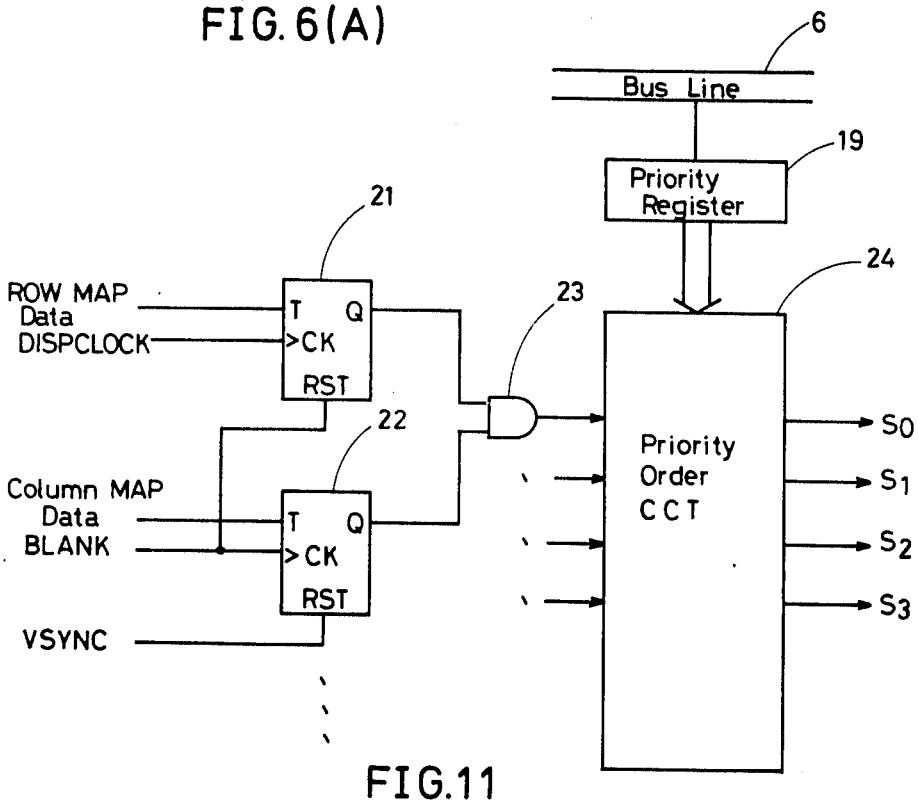
FIG. 11 is a block diagram of a window select circuit connected in the circuit of FIG. 9.
Figure 10:
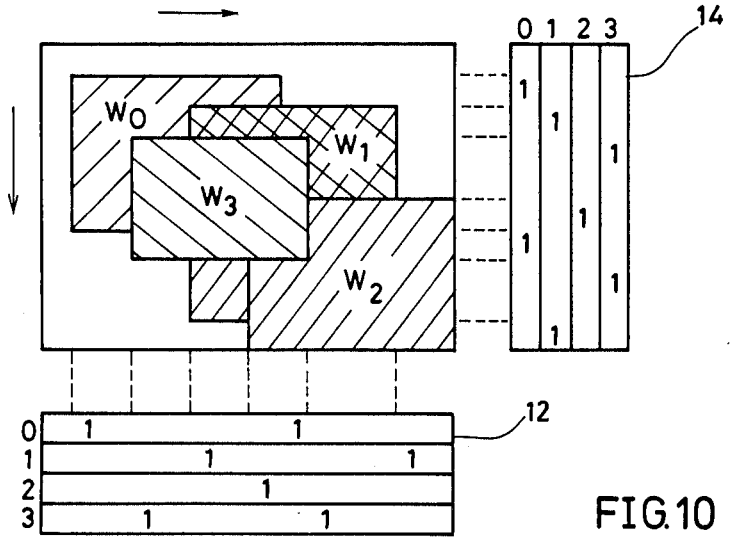
FIG. 10 is an explanatory drawing of a row map RAM and a column map RAM connected in the circuit of FIG. 9.

FIG. 10 is an explanatory drawing of a memory format of each of the row map RAM 12 and the column nap RAM 14 in conjunction with a multiwindow picture. FIG. 11 is a block diagram of the window select circuit 15 of FIG. 9.

When a plurality of windows are overlapped, the priority register 19 is provided for selecting the priority of overlapping the plurality of windows. Responsive to the priority register 19, a priority order circuit 24 is operated to decide the overlapping order. By passing the priority order circuit 24, of a single of window is selected at the same time. One of bias registers $16_0$–$16_3$ corresponding to the selected one of the window numbers S0–S3 is selected by the multiplexer 17. The full adder 18 is operated for adding one of the bias values "$alpha_0$–$alpha_3$" to the address a of each of the address counters 11 and 13. Thus, the address a′ is obtained, accessing a location of the picture information memory to display a multiwindow.

The T-type flip-flops 21 and 22, and the AND gate 23 are operated in the same way as in FIG. 8.

FIGS. 12(A) and 12(B), and 13(A) and 13(B) are schematic comparative drawings of the contents of the priority register 19 and the multiwindow displays.

Figure 12A:
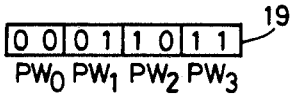
FIGS. 12(A) and 12(B), and 13(A) and 13(B) are schematic comparative drawings of priority register contents and multiwindow pictures.
Figure 13:
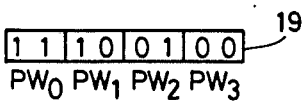
Figure 12:
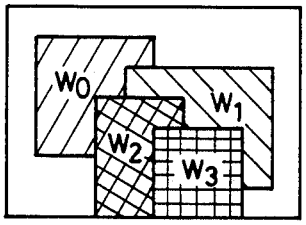
Figure 13:
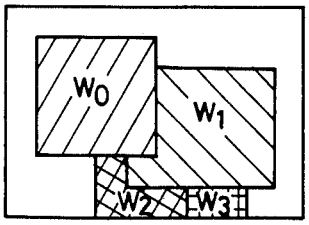

When four windows are used, the priority register 19 should be of 8 bits (=2 bits×4). Each of the bits are defined "00", "01", "10", and "11" from the lower priority. In FIG. 12(A), the priority order is W0 <W1 <W2 <W3, so that the display of FIG. 12(B) is displayed. In FIG. 13(A), with the same boundary conditions, the priority of W0>W1>W2>W3 is defined, so that the display of FIG. 13(B) is obtained.

In FIG. 9, the contents of the priority register 19 can be variably arranged.

The application of the multiwindow display circuit according to the present invention can be applied to any display including a character display, a bit map display, a cathode ray tube (CRT), an electroluminescent display (EL), and a plasma display.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A multiwindow display circuit comprising:

display means for displaying picture information;

horizontal memory means for storing horizontal boundary data for each of a plurality of display windows on said display means, which display windows define respective portions of said display means;

vertical memory means for storing vertical boundary data for each of said plurality of display windows on said display means;

display address means for storing a leading address for each of said plurality of display windows, said leading addressed defining initial picture information for each of said plurality of display windows stored in picture information memory means;

bias memory means for storing bias values associated with each of said plurality of display windows;

address converter means for adding a particular bias value to a selected address of said display address means in order to provide a converted display address; and display timing circuit means responsive to said converted display address for displaying the picture information associated with said selected address on said display means according to said converted display address within the boundaries defined by the horizontal and vertical boundary data for the display window corresponding to said selected address, whereby selected picture information may be displayed at any area of said display means.

2. The circuit of claim 1, wherein the horizontal and vertical boundary data represent the corners of said display windows.

3. The circuit of claim 1, wherein said address converter means further comprises window select means for selecting a particular display window in accordance with said selected address of the display address means.

4. The circuit of claim 3, wherein said address converter means further comprises multiplexer means responsive to said window select means and said display address means for selecting a particular bias value to be added to the selected address of said display address means.

5. The circuit of claim 3, further comprising priority means for selecting display window priority with respect to overlapping of said display windows.

* * * * *